US005272789A

United States Patent [19]

Mitchell et al.

[11] Patent Number: 5,272,789

[45] Date of Patent: Dec. 28, 1993

[54] SELF-CLOSING DOOR HINGE

[75] Inventors: Terry L. Mitchell, Jenison; Todd A. Sutton, Grand Rapids, both of Mich.

[73] Assignee: Quest Engineering, Ltd., Grand Rapids, Mich.

[21] Appl. No.: 896,149

[22] Filed: Jun. 9, 1992

[51] Int. Cl.[5] ..... E05F 1/08

[52] U.S. Cl. ..... 16/291; 16/278

[58] Field of Search ..... 16/291, 278, 279

[56] References Cited

U.S. PATENT DOCUMENTS

| | | |
|---|---|---|
| 428,974 | 5/1890 | Taxis . |
| 434,212 | 8/1990 | Taxis . |
| 747,275 | 12/1903 | Tscherning . |
| 747,276 | 12/1903 | Tscherning . |
| 833,734 | 10/1906 | Diehl . |
| 842,519 | 1/1907 | Brothers . |
| 2,183,210 | 12/1939 | Anderson . |
| 2,294,575 | 9/1942 | Schneider . |
| 2,322,933 | 6/1943 | Harmon et al. . |
| 2,335,201 | 11/1943 | Ulrich . |
| 2,611,922 | 9/1952 | Borman et al. . |
| 2,706,307 | 4/1955 | Anderson . |
| 2,812,539 | 11/1957 | Lundell . |
| 2,865,653 | 12/1958 | Nixon . |
| 2,869,959 | 1/1959 | Kesling . |
| 2,911,667 | 11/1959 | Burke . |
| 3,001,226 | 9/1961 | Squire . |
| 3,005,227 | 10/1961 | Horvay . |
| 3,125,390 | 3/1964 | Woolley . |
| 3,205,532 | 9/1965 | MacDonald . |
| 3,228,058 | 1/1966 | MacDonald . |
| 3,254,452 | 6/1966 | Costantini et al. . |
| 3,287,757 | 11/1966 | Van Noord . |
| 3,344,462 | 10/1967 | Webster . |
| 3,388,954 | 6/1968 | Smith . |
| 3,395,423 | 8/1968 | Bus ..... 16/365 |
| 3,430,386 | 3/1969 | Sandin et al. . |
| 3,608,129 | 9/1971 | Heyer et al. . |
| 3,638,277 | 2/1972 | Coe . |
| 3,785,006 | 1/1974 | Metz . |
| 3,863,391 | 2/1975 | Horvay et al. . |
| 3,996,699 | 12/1976 | Crowe . |
| 4,084,291 | 4/1978 | Crowe . |
| 4,151,681 | 5/1979 | Roberts . |
| 4,158,271 | 6/1979 | Barry . |
| 4,215,449 | 8/1980 | Loikitz . |
| 4,319,382 | 3/1982 | Zernig . |
| 4,547,929 | 10/1985 | Lew et al. . |
| 4,654,930 | 4/1987 | Lautenschlager, Jr. et al. . |
| 4,690,468 | 9/1987 | Lau . |
| 4,971,382 | 11/1990 | Ohno . |
| 4,979,265 | 12/1990 | Grass . |
| 5,020,189 | 6/1991 | Grome et al. . |
| 5,027,473 | 7/1991 | Hottmann . |

*Primary Examiner*—Lowell A. Larson
*Assistant Examiner*—Carmine Cuda
*Attorney, Agent, or Firm*—Price, Heneveld, Cooper, Dewitt & Litton

[57] ABSTRACT

A spring biased hinge for refrigerator doors and the like includes a stationary mounting bracket, a bent-wire spring mounted between the door and bracket, and a pivot pin for pivotally mounting the door to the mounting bracket. The mounting bracket is reversible so that it can be used on either side of the door, and includes a slot for receiving an end of the spring, the slot and spring being located so that as the door is opened, the door travels through a first arcuate segment where the spring is compressed and oriented to bias the door closed, through a second arcuate segment where the spring is compressed and oriented to bias the door open, and a third arcuate segment where the spring is not compressed but rather slides in the slot allowing the door to swing freely open until an end of the slot is engaged to limit the maximum door open movement. The hinge is characterized by its low profile and low number of parts.

28 Claims, 3 Drawing Sheets

SELF-CLOSING DOOR HINGE

BACKGROUND OF THE INVENTION

The present invention relates to hinges, and in particular to a hinge including a self-closing feature.

Spring biased hinges are commonly used on refrigerator doors to bias them closed so that they do not accidentally remain ajar. However, many spring biased hinges build up an undesirably high biasing force when the doors are fully opened since the springs continue to compress as the doors open. This is undesirable since it tends to cause the doors to slam shut. Further, many consumers prefer that, once the refrigerator door is opened, the door stay open and/or swing freely so that the door does not interfere when the user is cleaning, accessing or restocking the refrigerator. Another problem is that many of the spring biased hinges have a bulky profile which tends to detract from the overall appearance of the refrigerator. Still further, most spring biased hinges include multiple parts which are more expensive to manufacture and assemble than is desirable.

Some refrigerator door hinge designs use an over-center spring arrangement wherein the spring provides a reduced biasing torque as the door is opened. This is because, in over-center springs, the direction of the spring force approaches the axis of rotation as the door is opened. Further, the over-center spring may provide a reverse biasing force to hold the door open once the spring passes over-center. U.S. Pat. No. 4,690,468 discloses such an arrangement. However, these over-center spring hinges typically do not provide a "bias free", zone of door movement, as is desired as noted above, and can actually cause the door to swing open and strike an appliance or counter top positioned adjacent the door. Further, in most of these hinges, the over-center spring passes through the axis of rotation as the door is opened, thus complicating the hinge pivoting arrangement and increasing the number of parts required. Also, the more complicated of these hinges have a bulky profile due to the size of the spring and the other components contained therein. Still further, often a different hinge bracket must be used for each different arrangement of doors, such as for right hand or left hand mounted doors, or for top and bottom mounted doors.

Camming arrangements are also sometimes used to accomplish the desired biasing of the door. Typically, a cam follower is biased into engagement with a cam as the door is opened, the cam being shaped to generate a closing force or to allow the door to swing freely, depending upon the door position. U.S. Pat. No. 4,215,449 discloses such an arrangement. However, the cam and cam follower take up vertical space and, hence, do not present a low profile. Further, camming arrangements generally tend to involve multiple parts and moving pieces that add to the complexity of the hinge design.

In one known camming arrangement, a beveled washer is installed around the door pivot, and as the door rides up the ramp, gravity generates a closing force on the door. However, while the arrangement has few parts, the vertical door movement causes door alignment problems.

Hence, an improved door hinge is desired.

SUMMARY OF THE INVENTION

The present invention includes a spring biased hinge for refrigerator doors and the like. The hinge arrangement includes a stationary mounting bracket adapted to mount to a refrigerator cabinet for pivotally mounting a refrigerator door thereto, with one of the refrigerator door and the bracket including a slot and the other including an aperture. A means is provided for pivotally mounting the refrigerator door to the bracket, the means defining an axis of rotation for the door, with the slot and the aperture being spaced from the axis of rotation. A spring is operably mounted to the door and the bracket with one end of the spring operably mounted in the aperture and another end operably slideably mounted in the slot. The slot, the aperture and the spring are located so that the spring is mounted in an over-center relationship to the axis of rotation so that as the door is opened the door travels through a first arcuate segment where the spring biases the door toward a closed position. As the door is further opened, it travels through a second arcuate segment where the spring biases the door toward an open position. As the door is still further opened, it travels through a third arcuate segment where the spring slides in the slot allowing the door to swing freely in an unbiased condition.

In a narrower aspect, the spring engages an end of the slot to limit the extreme open position of the door.

In another aspect, the over-center spring does not pass through the axis of rotation, thus allowing a single pivot pin to be used to mount top and bottom doors to the mounting bracket.

In another aspect, the invention includes a door hinge having a bracket adapted to be mounted to a refrigerator cabinet for pivotally supporting first and second doors, and further includes pivot means for pivotally mounting the doors. The hinge further includes first and second over-center springs connected to the respective first and second doors and to the bracket to initially bias the doors toward a closed position as the doors are opened and then bias the doors toward an open position as the doors are further opened. In a narrower aspect, the bracket includes two slots for slideably receiving the springs so that both doors are allowed to swing freely as the doors are opened through the third arcuate segment. In another narrower aspect, the pivot means includes a single pivot pin for pivotally mounting both doors.

In the preferred embodiment, the bracket is reversible and can be used on right hand or left hand doors, and further has a low profile so that the hinge is particularly adapted for refrigerator doors that are mounted in a top and bottom arrangement and closely spaced, both top and bottom doors being mounted on a single pivot pin. Still further in the preferred embodiment, a plurality of bent-wire springs are provided, the springs having different spring rates so that a spring can be selected to create a desired biasing force for a door having a particular weight.

The present invention has several advantages over known hinges. The present hinge provides a desired pattern of biasing force to initially bias the door closed during a first arcuate segment, then bias the door open as the door moves through a second arcuate segment, and then allow the door to swing free as the door is opened still further through a third arcuate segment. The present hinge maintains positive door alignment because the door does not move up and down when opened. Also, the hinge is low in cost because the parts are relatively easily formed and only a minimum number of parts are required. Further, the design can be readily adapted to use for top, bottom and intermediate locations where support is required for refrigerator doors, the same hinge being useable in either right hand or left hand applications. Still further, the low profile permits use of optional aesthetic covers to improve the visual appearance of the hinge area. In the preferred embodiment, the hinge provides a positive closure force if the door is opened less than about 45°, a positive opening force if the door is opened between about 45° to about 90°, and provides a free unbiased zone of door movement at about 90° to about 168° with a substantially positive stop at the maximum open position of 168°. By changing the diameter or spring rate of the wire used to form the spring, the force can be easily customized to work on different refrigerators.

These and other features, advantages, and objects of the present invention will be further understood and appreciated by those skilled in the art by reference to the following specification, claims and appended drawings.

DETAILED DESCRIPTION OF THE PREFERRED EMBODIMENT

Figure 2:
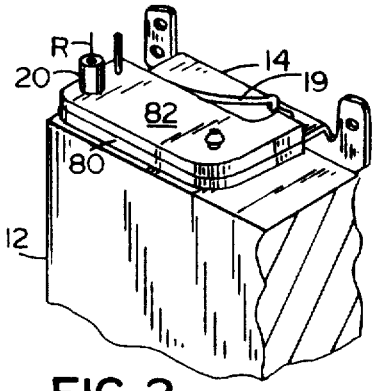
FIG. 2 is a perspective view of the hinge in FIG. 1 shown with a fragmentary portion of the bottom door but with the refrigerator cabinet and top door having been removed for clarity.
Figure 1:
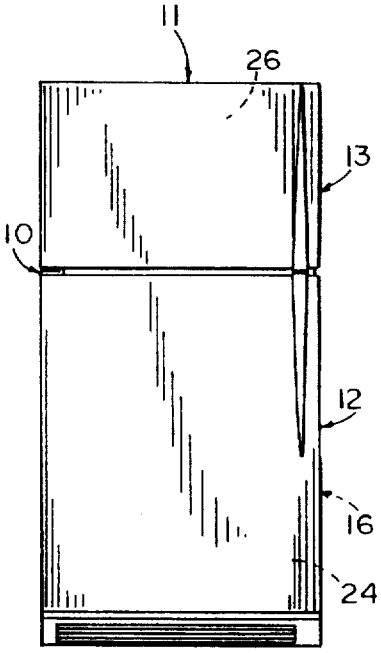
FIG. 1 is a front elevational view of a refrigerator including a hinge embodying the present invention.

A spring biased hinge 10 (FIGS. 1-3) embodying the present invention is provided for use on a refrigerator 11 having a first refrigerator door 12 and second freezer door 13 located above refrigerator door 12. Hinge 10 includes a stationary mounting center bracket 14 mounted to refrigerator cabinet 16, a first bent-wire over-center spring 18 operably mounted between door 12 and bracket 14 and a second bent-wire over-center spring 19 operably mounted between door 13 and bracket 14. A pivot pin 20 operably pivotally mounts doors 12 and 13 to bracket 14 and, in turn, to the refrigerator cabinet 16.

In the embodiment shown, refrigerator 11 includes a cabinet 16 defining a pair of adjacent top and bottom storage spaces 24 and 26 with corresponding access openings, respectively, formed in the face thereof. The pair of top and bottom doors 12 and 13 adapted to closingly cover storage spaces 24 and 26 are pivotally connected to cabinet 16 by a top and bottom bracket (not shown) and by pivot pin 20 which extends through an aperture in center bracket 14.

Center bracket 14 (FIG. 3) includes a plate-like body 32 with a mounting flange 34 extending perpendicularly to body 32 along a rearward edge. Mounting flange 34 includes two opposing mounting ears 34A and 34B with multiple holes such as holes 36, 37 and 38 therein for mounting bracket 14 with screws (not shown) to cabinet 16 in a secure manner. When mounted to cabinet 16, body 32 of bracket 14 extends forwardly of the face of cabinet 16.

Bracket body 32 includes a laterally extending tongue 40 with an aperture 42 therein. Pivot pin 20 has an integral washer 46 centrally located on pin 20 so that pivot pin 20 fits into aperture 42 with the washer 46 resting on tongue 40. Door 12 fits upwardly onto the lower portion of pin 20 and door 13 fits downwardly onto the upper portion of pin 20. Top and bottom brackets (not shown) located above and below doors 12 and 13, respectively and top and bottom pivot pins (not shown) hold doors 12 and 13 in place on pin 20. Pivot pin 20 thus defines an axis of rotation "R" for the doors 12 and 13.

Bracket 14 (FIG. 3) includes two elongated apertures or slots 54 and 56 on body 32 spaced from aperture 42 in bracket tongue 40, slot 54 extending perpendicularly to flange 34 and slot 56 extending parallel to flange 34. Slots 54 and 56 define remote or "far" ends 57 and 58, respectively, which are located farthest from aperture 42, and inner or "near" ends 60 and 62, respectively, which are located a distance closer to but still spaced from aperture 42.

Figure 3:
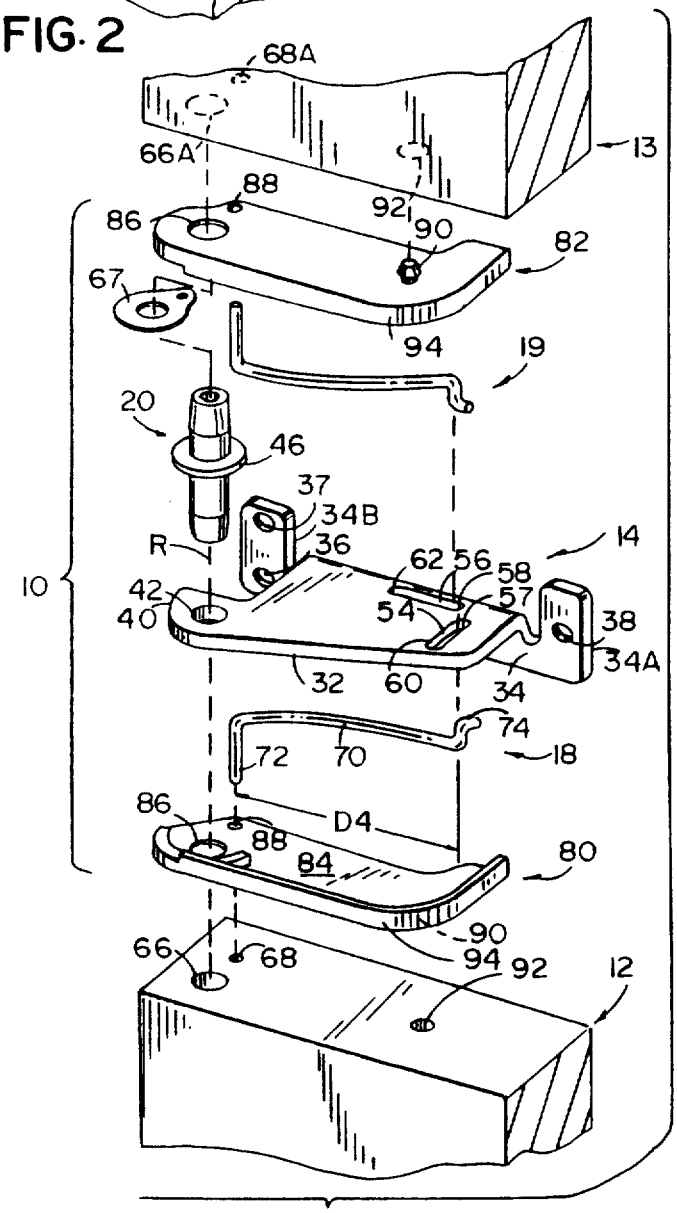
FIG. 3 is an exploded perspective view of the hinge assembly including fragmentary portions of the refrigerator doors.

As shown in FIG. 3, door 12 includes a hole 66 for receiving pivot pin 20, and also includes a second smaller hole 68 spaced from first hole 66. Door 12 includes a bearing (not shown) which is adapted to operably receive pivot pin 20 so that door 12 can pivotally freely swing on pivot pin 20, with hole 68 tracing an arc therearound as door 12 is opened. One or more spacers 67 are used to space door 13 above (or door 12 below) bracket 14 as desired. A plane "P" (FIG. 4) is defined by connecting axis "R" with a point defined by remote end 57 of slot 54. With door 12 closed, the distance from hole 68 to slot end 57 is defined as distance "D1". As door 12 is opened 45°, hole 68 moves from a position on one side of the plane "P" to a position on plane "P", the distance between door hole 68 and slot end 57 being defined as a minimum distance "D2". As door 12 is further opened beyond 45° to 90° and beyond (FIG. 5), hole 68 moves to a position on the other side of plane "P". In the farthest open position (FIG. 6), the distance from hole 68 to the inner slot end 60 defines a distance "D3".

Wire spring 18 (FIG. 3) has a curvilinearly-shaped central portion or body 70 with perpendicularly oriented bent end 72 adapted to extend into door hole 68, and a laterally extending L-shaped bent end 74 adapted to slideably retainably engage slot 54. It is contemplated that spring 18 will be made from a strand of stiff, resilient wire with body 70 being bent to an arcuate shape, however, the invention is not intended to be limited to such an arrangement. Notably, in the free state, spring ends 72 and 74 define a distance "D4" that is somewhat greater than distance "D1" noted above.

To use hinge 10, bracket 14 is initially assembled to cabinet 16 and door 12 is assembled to bracket 14 on pivot pin 20 with spring 18 operably mounted therebetween. In particular, spring end 72 is located in door hole 68 and spring end 74 is located in slot 54. This compresses spring 18 slightly since the free state distance "D4" (FIG. 3) is greater than the distance "D1" (FIG. 4) to which spring 18 is forced. Since hole 68 is on the "closed" side of plane "P", spring 18 biases door 12 toward a closed position as the door is moved through a first arcuate segment from 0° to 45°. As door 12 is opened past 45°, hole 68 passes through plane "P", and the reactive force generated by compressing spring 18 operates to open door 12. Notably, when door 12 is located at or near 45°, spring 18 is compressed the greatest amount. However, this does not translate into the greatest biasing force since the force of the spring operates substantially in-line with axis "R" so that any torque arm is very small. Once hole 68 is on the "open" side of plane "P", spring 18 biases door 12 toward the open position as the door is moved through a second arcuate segment from 45° to about 90°. Advantageously, since hole 68 never crosses behind pivot pin 20, a single pivot pin 20 can be used to mount both doors 12 and 13.

As door 12 reaches a position slightly beyond 90° (FIG. 5), spring 18 is held in a condition where it is completely relaxed and does not bias door 12. As door 12 moves from 90° to 168° in a third arcuate segment, spring end 74 slides within slot 54 allowing the door 12 to swing freely in a "free unbiased" zone. As door 12 reaches about 168° (FIG. 6), spring 18 contacts slot inner end 60 such that further arcuate movement of door 12 is positively limited. Notably, the curvature of spring central portion 70 offers a small amount of cushioning as spring 18 acts to positively limit the maximum open position of door 12. In the maximum open position, distance "D3" is equal to distance "D4".

Figure 4:
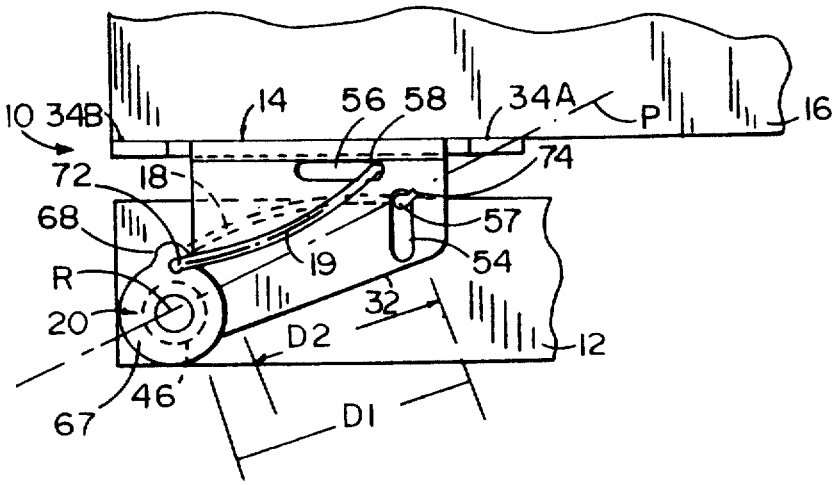
FIG. 4 is a plan view of the hinge with the top refrigerator door being removed for clarity and the bottom door being shown in the closed position.
Figure 5:
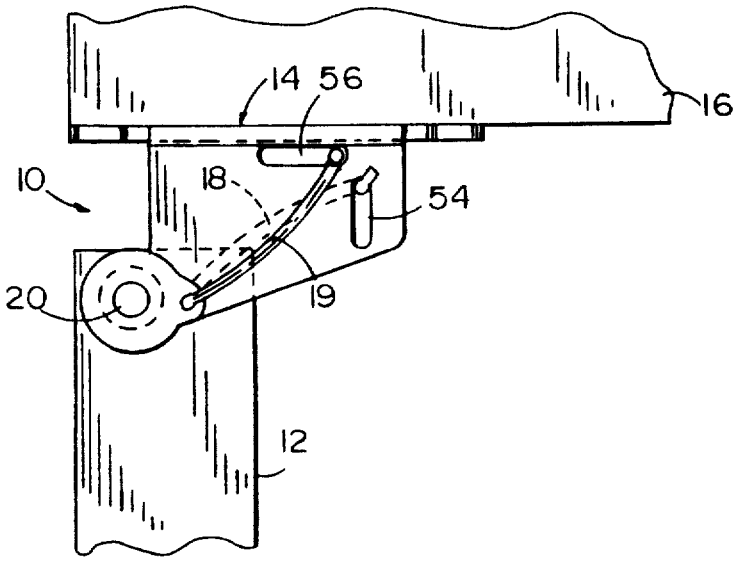
FIG. 5 is a plan view of the hinge as shown in FIG. 4 but with the bottom door being shown in a 90° open position.
Figure 6:
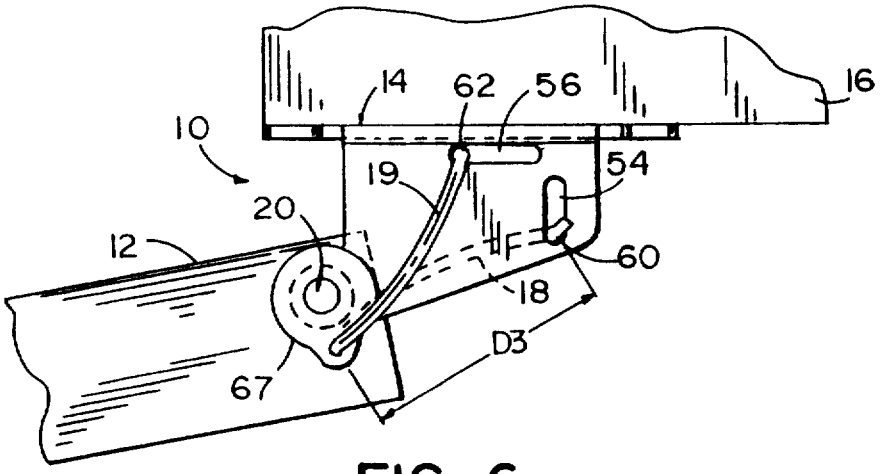
FIG. 6 is a plan view of the hinge as shown in FIG. 4 but with the bottom door being shown in a maximum open position.

Door 13 is substantially similar to door 12 as far as its connection to hinge 10. In particular, door 13 (FIG. 3) has a pivot pin receiving hole 66A and a spring end receiving hole 68A positioned relative to axis "R" and slot 56 very similar to that of door 12, door 13 being substantially a mirror image of door 12 in the area of concern. Spring 19 extends between hole 68A in door 13 and slot 56 in bracket 14. The operation of door 13 and spring 19 are otherwise substantially identical to the door 12 and spring 18, and spring 19 similarly acts on door 13 as door 13 is opened from 0° to 168° in substantially the same manner as spring 18 does on door 12 as is shown in FIGS. 4–6. Notably, though both of springs 18 and 19 are shown in the figures as if doors 12 and 13 are opened the same amount, the doors can obviously be opened independently so that springs 18 and 19 operate on the respective doors independently.

Notably, spring 18 can be rotated 180° to become spring 19. Thus, springs 18 and 19 can be identical in shape. Alternatively, spring 19 can be made different in shape, size or strength so that if upper door 13 has a different mass than door 13, it can be given an appropriate spring biasing force.

One or more aesthetic covers such as upper and lower covers 80 and 82 (FIGS. 2 and 3) can be added to improve the visual appearance of hinge 10. The cover 80 illustrated has a planar body 84 with a first hole 86 adapted to matingly receive pivot pin 20, and a second hole 88 adapted to align with door hole 68. Body 84 further includes a protrusion 90 for releasably engaging a retaining hole 92 in door 12 to retain cover 80 in place on door 12, and a ledge 94 extending partially around the outer perimeter of cover 80 to enclose the visible portion of bracket 14. Cover 82 is substantially a mirror image of cover 80 and attaches to the bottom of top door 13 in a manner similar to cover 80. Notably, covers 80 and 82 move with doors 12 and 13, respectively, as same are opened.

Notably, hinge bracket 14 can be reversed 180° so that the same bracket is usable in either right-hand or left-hand door mounting applications. Further, hinge bracket 14 can be used in either top or bottom hinge locations on cabinet 18 with only minor changes thereto such as by forming flanges 34 so that they extend only to one side of body 32, i.e., either only above body 32 or only below body 32. Still further, springs 18 and 19 can be substituted for each other, or can be selected from a plurality of differently shaped springs or spring with different spring rates as needed for different biasing forces. Due to the low profile of hinge 10, it neatly fits between doors 12 and 13 even if same are closely spaced. Hinge 10 further provides a clean appearance, which can be further improved by the addition of aesthetic covers 80 and 82.

Figure 7:
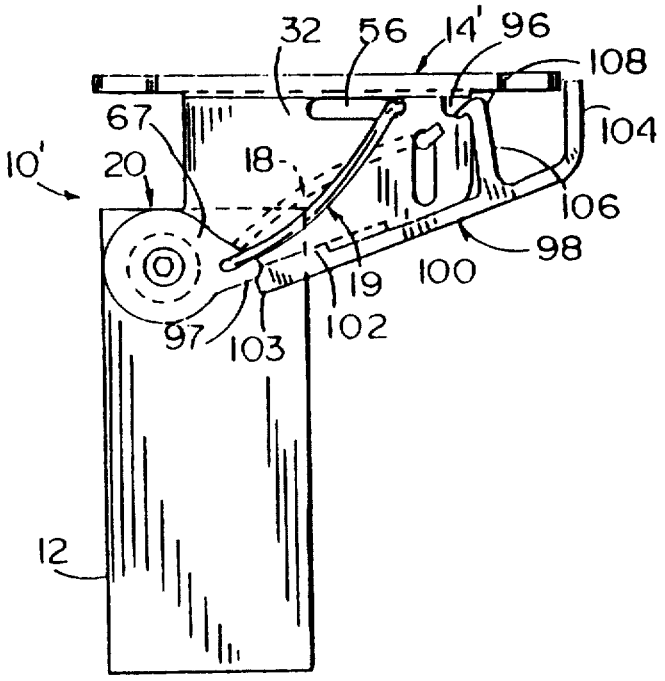
FIG. 7 is a plan view of another bracket embodying the present invention, the bracket being adapted to receive an aesthetic cover.
Figure 8:
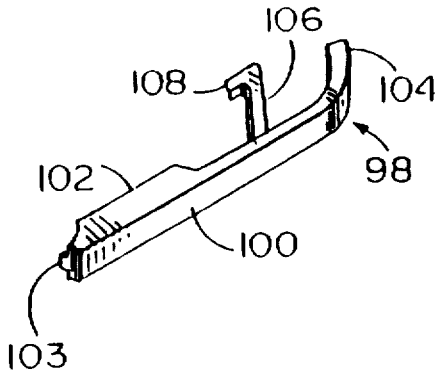
FIG. 8 is a perspective view of the aesthetic cover shown in FIG. 7.

A modified hinge 10' embodying the present invention is shown in FIG. 7. For the purposes of simplifying the description of hinge 10', all features similar to hinge 10 are designated by using the same number but with a prime thereafter. Hinge 10' includes a bracket 14' modified with a notch 96 near a rearward right part of bracket body 32' and a second notch 97 near a forward left part thereof. A modified snap-on stationary one-piece cover 98 (FIG. 8) includes an elongated body 100 with a pair of rearwardly extending flanges 102 and a forward lip 103 on one end, and a curved tail 104 on the other end. A protrusion 106 extends rearwardly at a location spaced from, but near, tail 104, protrusion 106 including a hooked end 108. Cover 98 can be installed onto bracket 14' by placing the front edge 110 of bracket body 32' between flanges 102 and pressing cover 98 rearwardly. This causes forward lip 103 and hooked end 108 to engage notches 97 and 96, respectively, in an opposing manner so as to hold cover 98 on bracket 14'. Notably, cover 98 ends short of the area adjacent pivot pin 20 so that cover 98 does not interfere with springs 18 and 19 during the opening of doors 12 and 13.

Thus, a hinge is provided for use in a refrigerator door and the like, the hinge of the preferred embodiment including only a bracket, a pivot pin, and one or two door biasing springs, along with aesthetic covers if desired. In the preferred embodiment, the bracket is reversible, and includes two slots so that both the top and bottom doors can be biased as desired. Further, the hinges provide a first arcuate segment whereat the door is biased closed, a second arcuate segment whereat the door is biased opened, and a third arcuate segment whereat the door is allowed to swing free but is limited to a maximum movement.

Having described the hinge of the present embodiment, various advantages and uses will become apparent to those skilled in the art. Further, upon reading the foregoing description, it will be readily appreciated by those skilled in the art that modification may be made to the invention without departing from the concepts disclosed herein. Such modifications are considered as included in the following claims unless these claims by their language expressly state otherwise.

The embodiments of the invention in which an exclusive property or privilege is claimed are defined as follows.

1. A spring biased door hinge arrangement for refrigerators, comprising:

a refrigerator door;

a stationary mounting bracket adapted to mount to a refrigerator cabinet, one of the refrigerator door and the bracket including a slot and the other including an aperture;

means for pivotally mounting the refrigerator door to the bracket, said means defining an axis of rotation for the door, the slot and the aperture being spaced from the axis of rotation;

a single spring having one end operably mounted in the aperture and another end operably slideably mounted in the slot to affect movement of the door; and the slot, the aperture and the single spring being located so that the spring is mounted in an over-center relationship to the axis of rotation so that as the door is opened the door travels through a first arcuate segment whereby the spring biases the door toward a closed position, so that as the door is further opened the door travels through a second arcuate segment where the spring biases the door toward an open position to swing the door to said open position, and so that as the door is finally still further opened the door travels through a third arcuate segment where the spring slides in the slot with no biasing affect on the door so that the door swings freely in an unbiased condition.

2. A door hinge arrangement as defined in claim 1 wherein the bracket includes the slot.

3. A door hinge arrangement as defined in claim 2 wherein said bracket is reversible so that said bracket can be operably mounted on either side of the access opening by rotating the bracket 180 degrees, whereby said bracket can be used in either a right-hand or left-hand hinge arrangement.

4. A door hinge arrangement as defined in claim 3 wherein the spring has a central portion that is curvilinear in shape with respect to the spring ends.

5. A door hinge arrangement as defined in claim 4 wherein the spring is made from a single strand of wire bent into an elongate concave shape.

6. A door hinge arrangement as defined in claim 1 wherein the another spring end engages the slot end to limit the maximum door open movement in the third arcuate segment.

7. A door hinge arrangement as defined in claim 6 including a plurality of springs having different spring lengths so that a particular spring can be selected to limit the door to a maximum open position.

8. A door hinge arrangement as defined in claim 1 wherein the spring does not cross through the axis of rotation during the opening of the door.

9. A door hinge arrangement as defined in claim 1 including a removable cover adapted to attach to the bracket without the use of separate fasteners, said cover being adapted to aesthetically cover the bracket and the spring.

10. A door hinge arrangement as defined in claim 1 wherein said spring includes a body connecting said spring ends, said body having a concave shape.

11. A door hinge arrangement as defined in claim 10 wherein said body is formed from a wire and defines a plane when viewed in profile that has a thickness about equal to the thickness of the wire.

12. A door hinge arrangement as defined in claim 1 wherein said spring is made from wire and includes a body connecting the spring ends, said body and said bracket having a thin profile approximating the combined thickness of the wire and the bracket which permits refrigerators having top and bottom door arrangements to be closely spaced with the hinge arrangement located therebetween for maximum aesthetics.

13. A door hinge arrangement for refrigerators, comprising:

a refrigerator door;

a stationary mounting bracket adapted to mount to a refrigerator cabinet, one of the refrigerator door and the bracket including a slot and the other including an aperture;

means for pivotally mounting the refrigerator door to the bracket, said means defining an axis of rotation for the door, the slot and the aperture being spaced from the axis of rotation;

a single spring having one end operably mounted in the aperture and another end operably slideably mounted in the slot to affect movement of the door;

the slot, the aperture and the single spring being located so that the spring is mounted is an over-center relationship to the axis of rotation so that as the door is opened the door travels through a first arcuate segment where the spring biases the door toward a closed position, so that as the door is further opened the door travels through a second arcuate segment where the spring biases the door toward an open position to swing the door to said open position, and so that as the door is finally still further opened the door travels through a third arcuate segment where the spring slides in the slot with no biasing affect on the door so that the door swings freely in an unbiased condition;

a second refrigerator door, one of the second refrigerator door and the bracket including a second slot and the other including a second aperture;

second means for pivotally mounting the second refrigerator door to the bracket, the second means defining a second axis of rotation for the second door, the second slot and the second aperture being spaced from the second axis of rotation;

a second single spring having one end operably mounted in the second aperture and another end operably slideably mounted in the second slot to affect movement of the door; and the second slot, the second aperture and the second spring being located so that the second spring is mounted in an over-center relationship to the second axis of rotation so that as the second door is opened the second door travels through a first arcuate segment where the second spring biases the second door toward a closed position, so that as the second door is further opened the second door travels through a second arcuate segment where the second spring biases the second door toward an open position to swing the door to said open position, and so that as the second door is finally still further opened the second door travels through a third arcuate segment where the second spring slides in the second slot with no biasing affect on the door so that the second door swings freely in an unbiased condition.

14. A door hinge arrangement as defined in claim 13 wherein the first and second slots are both located on the bracket.

15. A door hinge arrangement as defined in claim 13 including a plurality of springs having different spring rates so that a particular spring can be selected for a door requiring a particular biasing force.

16. A door hinge for a refrigerator, the refrigerator including a cabinet defining first and second adjacent storage spaces with corresponding access openings to access each of the storage spaces, and further including first and second doors adapted to cover the respective corresponding access openings, comprising:

a bracket adapted to attach to the cabinet and at least partially support the first and second doors adjacent the corresponding access openings;

pivot means for pivotally mounting the first and second doors to said bracket so that the first and second doors each can be moved along arcuate paths between a fully closed position whereat the respective door covers the corresponding access opening and a fully open position whereat the corresponding access opening is fully exposed, said arcuate paths each defining first, second, and third arcuate segments respectively as the respective door moves from said fully closed position to said fully open position, said pivot means defining a common axis of rotation for the doors;

said bracket including a first aperture;

the first door including a second aperture, said second aperture being positioned so as to define a first variable distance between said first aperture and said second aperture that is gradually reduced as the first door moves through said first arcuate segment, said first variable distance being gradually increased as the first door moves through said second arcuate segment, and being still further increased as the first door moves through said third arcuate segment; said second aperture being located on one side of a first plane connecting said axis of rotation and said first aperture when the first door is in said first arcuate segment, and being positioned on another side of the first plane when the first door is in said second arcuate segment;

a first over-center spring including a first end operably connected to said first aperture and a second end pivotally connected to said second aperture and further including a body connecting said ends, said body defining a concave shape and a thin profile, said first and second ends of said first spring defining a free state distance when in a free state, said free state distance being equal to or greater than said variable distance when the first door is closed;

said bracket including a third aperture;

the second door including a fourth aperture, said third aperture in said bracket being positioned so as to define a second variable distance between said fourth aperture and said third aperture that is gradually reduced as the second door moves through said first arcuate segment, said second variable distance being gradually increased as the second door moves through said second arcuate segment, and being still further increased as the second door moves through said third arcuate segment; said fourth aperture being located on one side of a second plane connecting said axis of rotation and said third aperture when the second door is in said first arcuate segment, and being positioned on another side of the second plane when the second door is in said second arcuate segment;

a second over-center spring including a third end operably connected to said third aperture and a fourth end pivotally connected to said fourth aperture and further including a second body connecting said ends, said second body defining a concave shape and a thin profile, said second spring defining a free state distance between said third end and said fourth end that is equal to or greater than said second variable distance when the second door is closed; whereby said first and second springs bias the first and second doors, respectively, toward said closed position when the respective doors are in the first arcuate segment, and bias the respective doors toward said open position when in the second position; and wherein the first and third apertures are slots, and the first and second springs are adapted to slide in the respective first and third apertures when the respective doors are in the respective third arcuate segments so that the respective doors swing freely in an unbiased condition therein.

17. A door hinge as defined in claim 16 wherein the pivot means includes a single pivot pin for pivotally mounting both the first and second doors to the mounting bracket.

18. A door hinge as defined in claim 16 wherein the slots each include ends that engage the respective springs to limit the movement of the respective doors as the respective doors move to a maximum open position.

19. A door hinge as defined in claim 16 wherein the first and second springs are located on opposite sides of the bracket.

20. An over-center hinge for mounting a moveable door member to a stationary cabinet member, the moveable member having a hole therein offset from an axis of rotation defined by the moveable member, the moveable member being moveable from a closed position to an open position and defining first, second, and third arcuate segments as the moveable member is opened comprising:

a bracket having a first flange adapted to mount to the stationary member, and a second flange extending perpendicularly to said first flange, said second flange including pivot means defining the axis of rotation for pivotally mounting the movable member thereto and further including an elongated aperture, the elongated aperture having a near end and a far end relative to the pivot means, the aperture being located so that the hole in the moveable member is located on one side of a plane connecting the axis of rotation with the far end of the elongated aperture when the moveable member is in the first arcuate segment and the hole is also located on another side of the plane when the moveable member is in the second arcuate segments;

an elongated single spring having a first end adapted to be pivotally mounted to the hole and a second end slideably movably attached to the elongated aperture to affect movement of the door member, the first and second ends defining a distance so that the spring is compressed when the moveable member is in the first and second arcuate segments, but is in a free state when the moveable member is in the third arcuate segment with the second end of the spring being slideably movable within the elongated aperture as the moveable member is moved in the third arcuate segment; whereby the spring biases the moveable member toward the closed position when the moveable member is in the first arcuate segment and biases the moveable member toward the open position to swing the door member to said open position when the moveable member is in the second arcuate segment, but has no biasing affect on the moveable door member so that the moveable member swings freely in an unbiased state when in the third arcuate segment the bracket including a second elongated aperture; and a second elongated single spring having a third end adapted to be pivotally mounted to a second hole offset from the axis of rotation in a second moveable door member, and a fourth end slideably movably attached to the second elongated aperture to affect movement of the second door member, the third and fourth ends defining a distance so that the second spring is compressed when the second moveable member is in the first and second arcuate segments, but is in a free state when the second moveable member is in the third arcuate segment with the fourth end of the second spring being slideably moveable within the second elongated aperture as the second moveable member is moved in the third arcuate segment; whereby the second spring biases the second moveable member toward the closed position when the second moveable member is in the first arcuate segment and biases the second moveable member toward the open position to swing the second door member to said open position when the second moveable member is in the second arcuate segment, but has no biasing affect on the door so that the second moveable member swings freely in an unbiased state when in the third arcuate segment.

21. An over-center hinge for a refrigerator, the refrigerator including a cabinet defining a storage space and an access opening to access the storage space, and further including a door adapted to cover the access opening, comprising:

a bracket adapted to attach to the cabinet and at least partially support the door adjacent the access opening;

pivot means for pivotally mounting the door to said bracket so that the door can be moved along an arcuate path between a fully closed position whereat the door covers the access opening and a fully open position whereat the access opening is fully exposed, said path defining first, second, and third arcuate segments respectively as said door is moved from said fully closed position to said fully open position, said pivot means defining an axis of rotation;

said bracket including a first aperture;

the door including a second aperture, said second aperture being positioned so as to define a variable distance between said first aperture and said second aperture that is gradually reduced as the door moves from the closed position through said first arcuate segment, that is gradually increased as the door is further opened and moves through said second arcuate segment, and that is still further increased as the door is still further opened and moves through said third arcuate segment; said second aperture being located on one side of a plane connecting said axis of rotation and said first aperture when the door is in said first arcuate segment, and being positioned on another side of the plane when the door is in said second arcuate segment;

a single spring including a first end operably connected to said first aperture and a second end operably connected to said second aperture to affect movement of the door and further including a body connecting said ends, said body defining a concave shape and having a thin profile, said first and second ends of said spring defining a free state distance when in an uncompressed free state, said free state distance being equal to or greater than said variable distance when the door is closed; and one of said first aperture and said second aperture being elongated for loosely slideably retaining the respective end of said spring as the door moves through said third arcuate segment with said one elongated aperture being shaped so that said spring is in said free state during the movement of the door through said third arcuate segment; whereby said spring is compressed and biases the door toward said closed position when the door is in the first arcuate segment, and is compressed and biases the door toward said open position to swing the door to said open position when in the second arcuate segment, but is relaxed and does not provide a bias on the door so that the door swings freely when in the third arcuate segment.

22. An over-center hinge as defined in claim 21 wherein said bracket is reversible so that said bracket can be operably mounted on either side of the access opening by rotating the bracket 180 degrees, whereby said bracket can be used in either a right-hand or left-hand hinge arrangement.

23. A hinge for rotatably mounting a door to a stationary member, said hinge comprising:

a mounting bracket secured to one of said door and said stationary member, said bracket including means defining at least one elongated slot and means defining a pin receiving opening;

a pivot pin positionable in said bracket opening and anchored therein such that said pin and bracket will not rotate relative to each other, said pin having portions extending in opposite directions into said door and said stationary member whereby said door rotates relative to said stationary member about the axis of said pin, said door being movable through multiple segments from a closed position to an intermediate position to an opened position and to a fully opened position; and a single spring with two free ends and a maximum extendable length, one end being anchored to one of said door and said stationary member, the other being slideably anchored within said slot to affect movement of the door, so that as said door is moved between said closed position and said intermediate position said spring biases said door closed, so that as said door is moved between said intermediate position and said opened position said spring biases said door open to swing the door to said opened position, so that as said door is moved between said opened position and said fully opened position said spring has no biasing affect on the door so that said door swings freely in an unbiased condition, and so that as said door reaches the fully open position said spring dampens any further opening of said door and further positively limits the movement of said door past said fully open position.

24. An over-center hinge for mounting a moveable door member to a stationary cabinet member, the moveable member having a hole therein offset from an axis of rotation defined by the moveable member, the moveable member being moveable from a closed position to an open position and defining first, second, and third arcuate segments as the moveable member is opened comprising:

a bracket having a first flange adapted to mount to the stationary member, and a second flange extending perpendicularly to said first flange, said second flange including pivot means defining the axis of rotation for pivotally mounting the movable member thereto and further including an elongated aperture, the elongated aperture having a near end and a far end relative to the pivot means, the aperture being located so that the hole in the moveable member is located on one side of a plane connecting the axis of rotation with the far end of the elongated aperture when the moveable member is in the first arcuate segment and the hole is also located on another side of the plane when the moveable member is in the second arcuate segments; and an elongated single spring having a first end adapted to be pivotally mounted to the hole and a second end slideably movably attached to the elongated aperture to affect movement of the door member, the first and second ends defining a distance so that the spring is compressed when the moveable member is in the first and second arcuate segments, but is in a free state when the moveable member is in the third arcuate segment with the second end of the spring being slideably movable within the elongated aperture as the moveable member is moved in the third arcuate segment; whereby the spring biases the moveable member toward the closed position when the moveable member is in the first arcuate segment and biases the moveable member toward the open position to swing the door member to said open position when the moveable member is in the second arcuate segment, but has no biasing affect on the moveable door member so that the moveable member swings freely in an unbiased state when in the third arcuate segment.

25. An over-center hinge as defined in claim 24 wherein said bracket is reversible so that said bracket can be operably mounted on either side of the access opening by rotating the bracket 180 degrees, whereby said bracket can be used in either a right-hand or left-hand hinge arrangement.

26. A door hinge arrangement as defined in claim 24 wherein said spring includes a body connecting said spring ends, said body having a concave shape.

27. A door hinge arrangement as defined in claim 26 wherein said body is formed from a wire and defines a plane when viewed in profile that has a thickness about equal to the thickness of the wire.

28. A door hinge arrangement as defined in claim 24 wherein said spring is made from wire and includes a body connecting the spring ends, said body and said bracket having a thin profile approximating the combined thickness of the wire and the bracket which permits refrigerators having top and bottom door arrangements to be closely spaced with the hinge arrangement located therebetween for maximum aesthetics.

* * * * *

UNITED STATES PATENT AND TRADEMARK OFFICE

CERTIFICATE OF CORRECTION

PATENT NO. : 5,272,789

DATED : December 28, 1993

INVENTOR(S) : Terry L. Mitchell et al.

It is certified that error appears in the above-indentified patent and that said Letters Patent is hereby corrected as shown below:

Column 8, line 26, claim 13;
"is an" should be --in an--.

Signed and Sealed this

Ninth Day of August, 1994

*Attest:*

*Attesting Officer*

BRUCE LEHMAN

*Commissioner of Patents and Trademarks*